US005404933A

United States Patent [19]

Andersson et al.

[11] Patent Number: 5,404,933

[45] Date of Patent: Apr. 11, 1995

[54] METHOD AND A DEVICE FOR CASTING IN A MOULD

[75] Inventors: Erland Andersson, Ängelholm; Jan-Erik Eriksson, Västerås; Sten Kollberg, Västerås; Göte Tallbäck, Västerås, all of Sweden

[73] Assignee: Asea Brown Boveri AB, Västerås, Sweden

[21] Appl. No.: 87,701

[22] PCT Filed: Jan. 16, 1992

[86] PCT No.: PCT/SE92/00025

§ 371 Date: Jul. 9, 1993

§ 102(e) Date: Jul. 9, 1993

[87] PCT Pub. No.: WO92/12814

PCT Pub. Date: Aug. 6, 1992

[30] Foreign Application Priority Data

Jan. 21, 1991 [SE] Sweden ..... 9100184

[51] Int. Cl.[6] ..... B22D 27/02

[52] U.S. Cl. ..... 164/466; 164/502

[58] Field of Search ..... 164/466, 502

[56] References Cited

FOREIGN PATENT DOCUMENTS 0401504 12/1990 European Pat. Off. ..... 164/466

*Primary Examiner*—Kuang Y. Lin

*Attorney, Agent, or Firm*—Watson, Cole, Grindle & Watson

[57] ABSTRACT

A method and a device for controlling the flow of the molten metal in non-solidified portions of a cast strand in connection with casting of metal. A mould (11) is supplied with at least one primary flow (20) of molten metal and at least one strand (1) is formed in the mould. At least one static or periodic low-frequency magnetic field (10) is applied to act with a maximum magnetic field strength in the mould exceeding 1000 Gauss in the path of the inflowing molten metal to brake and divide the primary flow (20) of molten metal flowing into the mould and to control any secondary flows (21, 22) arising. The static magnetic field (10) acts over essentially the whole width (W) of the cast strand (1) formed in the mould, whereby the magnetic field strength in a plane across the casting direction, on a level with the centre of the range of action of the magnetic field (10), varies within an interval of 60 to 100 per cent of its maximum value, while at the same time the field strength on a level with the upper surface/the meniscus of the molten metal amounts to at most 500 Gauss. (FIG. 1)

5 Claims, 3 Drawing Sheets

METHOD AND A DEVICE FOR CASTING IN A MOULD

TECHNICAL FIELD

The invention relates to a method and a device for controlling the flow of liquid metal in non-solidified portions of a cast strand by means of static magnetic fields arranged adjacent to a mould used for forming the metal into a cast strand. Liquid metal—molten metal—flowing into the mould is slowed down and the flow of liquid metal in the non-solidified portions of a cast strand is controlled by controlling and distributing the propagation and intensity of the magnetic field, particles accompanying the molten metal thus being separated and floating up to the surface.

The invention is especially applicable to continuous casting in a chilled mould in which an uncontrolled inflow of hot molten metal containing slag particles or other nonmetallic particles, and/or an uncontrolled secondary flow, entail problems both from the point of view of quality and production technique.

BACKGROUND ART

In continuous casting, hot molten metal flows directly or through a casting tube into a mould. In the mould the molten metal is cooled and a solidified, self-supporting surface layer is formed before the strand, the blank, leaves the mould. If inflowing molten metal is allowed to flow into the mould in an uncontrolled manner, it will penetrate, due to its impulse, deep down into the non-solidified portions of the strand. This renders difficult the separation of particles trapped in the molten metal, which adhere to the solidification front instead of being separated to the upper surface. In addition, the self-supporting surface layer is weakened, which increases the risk of molten metal breaking through the surface layer formed in the mould.

From, for example, Swedish patent SE 436 251, it is known to arrange one or several static or periodic low-frequency magnetic fields in the path of the molten metal to brake and split up the inflowing molten metal. The magnetic fields are generated by means of magnetic poles, permanent magnets or induction coils supplied with direct current, and are arranged to act across the inflowing molten metal. The magnetic poles are arranged close to two opposite mould walls. However, the solution according to the above does not take into account any changes and non-symmetry in the flow configuration. Changes and non-symmetry in the flow configuration occur not only because of changed mould dimensions and non-symmetrical location of the casting tubes, but also by, for example, erosion and clogging which disturbs the flow out of the casting tube.

A non-symmetrical flow configuration entails great problems with regard to quality and production engineering: For example, hot molten metal, with or without non-metallic particles, may penetrate without being braked deep down into the non-solidified parts of the strand with ensuing quality problems. The upward flows of hot molten metal towards the upper surface, the meniscus, may become too weak, resulting in a risk of the meniscus freezing. If, instead, the upward flows become too strong, wave formation arises on the upper surface as a result of the turbulence, which pulls down slag from the upper surface into the molten metal with ensuing quality problems.

SUMMARY OF THE INVENTION

According to the invention, the flow of the molten metal in non-solidified portions of a strand is controlled in the casting of metal in which at least one strand—slab, bloom or billet—is formed in a mould which is downwardly open and which, directly or through a casting tube, is supplied with at least one primary flow of hot, inflowing molten metal, by means of at least one static or periodic, low-frequency magnetic field. The static magnetic field is generated close to the mould by means of magnetic poles, permanent magnets or coils supplied with direct current. The mentioned static magnetic field is applied to act with a maximum magnetic field strength in the mould exceeding 1000 Gauss. It acts in the path of the inflowing molten metal to brake and split up the primary flow of molten metal flowing into the mould and thus prevent inflowing hot molten metal from penetrating deep down into the non-solidified parts, the sump, of the strand without being braked. At the same time, part of the inflowing hot molten metal is controlled to flow towards the upper surface so as to obtain a desirable controlled circulation of molten metal in the non-solidified parts of the strand.

A controlled circulation of molten metal, a separation of particles trapped in the inflowing molten metal, and a controlled heat supply to the molten metal in the upper parts of the mould, without the turbulence close to the upper surface of the molten metal, the meniscus, becoming so great that waves are formed and particles are drawn down into the molten metal, are obtained by applying a static magnetic field, according to the invention, which in the mould has a maximum magnetic field strength exceeding 1000 Gauss. The static magnetic field is controlled and distributed, preferably by arranging the magnetic poles to be movable and/or providing them with adjustable core elements, to apply at least one static magnetic field to act over essentially the whole width, W, of the cast strand formed in the mould, the magnetic field strength varying within an interval of from 60 to 100 per cent of its maximum value in a plane across the casting direction, on a level with the centre of the range of action of the magnetic field while at the same time the magnetic field strength at the upper surface/the meniscus of the molten metal amounts to 500 Gauss at the most.

When the variations in the field strength of the magnetic field are larger than those mentioned above in a plane across the casting direction, on a level with the centre of the range of action of the magnetic field, undesired secondary flows arise.

The magnetic field is suitably controlled and distributed so that the maximum field strength in the mould amounts to between 1000 and 2000 Gauss, preferably between 1000 and 1800 Gauss.

To obtain a sufficient flow channel close to the meniscus and thus prevent it from freezing, while at the same time the flow in these upper parts of the non-solidified portions of the cast strand does not become so strong that waves are formed on the upper surface of the molten metal, the meniscus, in the application of magnetic fields according to the invention the magnetic poles should be arranged such that the centre of the range of action of the magnetic field, its pole centre, is arranged at a distance of 300 to 600 mm below the upper surface of the molten metal, the meniscus.

To apply the magnetic field close to the mould, a magnetic circuit is required in which the magnetic field may flow around. Such a magnetic circuit may comprise, in addition to the magnetic poles and the static magnetic field arranged between the poles, a magnetic return path, preferably in the form of an externally applied magnetic yoke. In this way the necessary magnetic flux balance is achieved for a strand or a mould. It is, of course, possible to locate the magnetic field, with associated poles and yokes so that magnetic flux balance is obtained for each mould half or for parts of a mould. The magnetic material included in the mould may advantageously be used as magnetic return path, and therefore, in many cases, special magnetic yokes are superfluous for obtaining magnetic circuits with magnetic flux balance.

According to a further embodiment of the invention, the distribution of the static magnetic field over essentially the whole width, W, of the strand formed in the mould is brought about by means of a pole plate arranged adjacent to a magnetic pole and a mould wall. The pole plates preferably extend along the long sides of the mould, Behind the pole plates a number of magnetic poles are arranged. Through the pole plates, magnetic fields from a plurality of magnetic poles are brought together and distributed to generate and apply a static magnetic field to act between the pole plates over essentially the whole width of the strand cast in the mould. In addition, by arranging pole plates the magnetic field is easier to adapt to variations in dimensions of the cast strand, for example the width of slabs in slabs casting.

The magnetic poles are preferably arranged according to the invention in water box beams arranged around the mould, or in a space between the water box beams and a frame structure surrounding them.

According to a previously described embodiment of the invention, the magnetic poles are arranged to be movable and/or with adjustable core elements. In this way, the propagation and intensity of the field can be controlled and distributed to ensure a good control of an incoming primary flow and secondary flows arising, in spite of the mounting limitations which exist in currently used conventional continuous casting moulds. The magnetic poles, in the form of loose coils or permanent magnets, are arranged in slots or on support beams arranged in or near the water box beams arranged around the mould.

According to an embodiment described above, the static magnetic field can be controlled and distributed by arranging the magnetic poles with adjustable core elements.

With magnetic poles in the form of coils supplied with direct current, this control is achieved by arranging the core of the coil with magnetic and non-magnetic sections which can be respectively inserted and replaced to change the geometry of the coil core and hence the propagation and intensity of the magnetic field generated by means of the coil.

With magnetic poles in the form of permanent magnets, the above-mentioned control is achieved by providing a pole core, arranged between the permanent magnet and the mould, with magnetic and non-magnetic sections which are inserted and replaced alternately to change the geometry of the pole core and hence the progation and intensity of the magnetic field generated by means of the permanent magnet.

Flow is an inert phenomenon, with a time constant of 10 seconds or more, and therefore intensity and direction of the static magnetic field can advantageously be adapted to vary in time, with a low frequency, to control the impulse of secondary flows arising.

By the invention, the movements of the molten metal in the non-solidified parts of the cast strand are controlled. Quality improvements are obtained since the separation of non-metallic particles is improved while at the same time the structure of the solidified metal is controlled. In addition, improvements from the production point of view are obtained since the risks of remelting of the solidified surface layer or freezing of the upper surface of the molten metal are essentially eliminated, which is reflected in increased productivity in the plant as a result of improved availability and increased casting speed.

DESCRIPTION OF THE PREFERRED EMBODIMENTS

Figure 1:
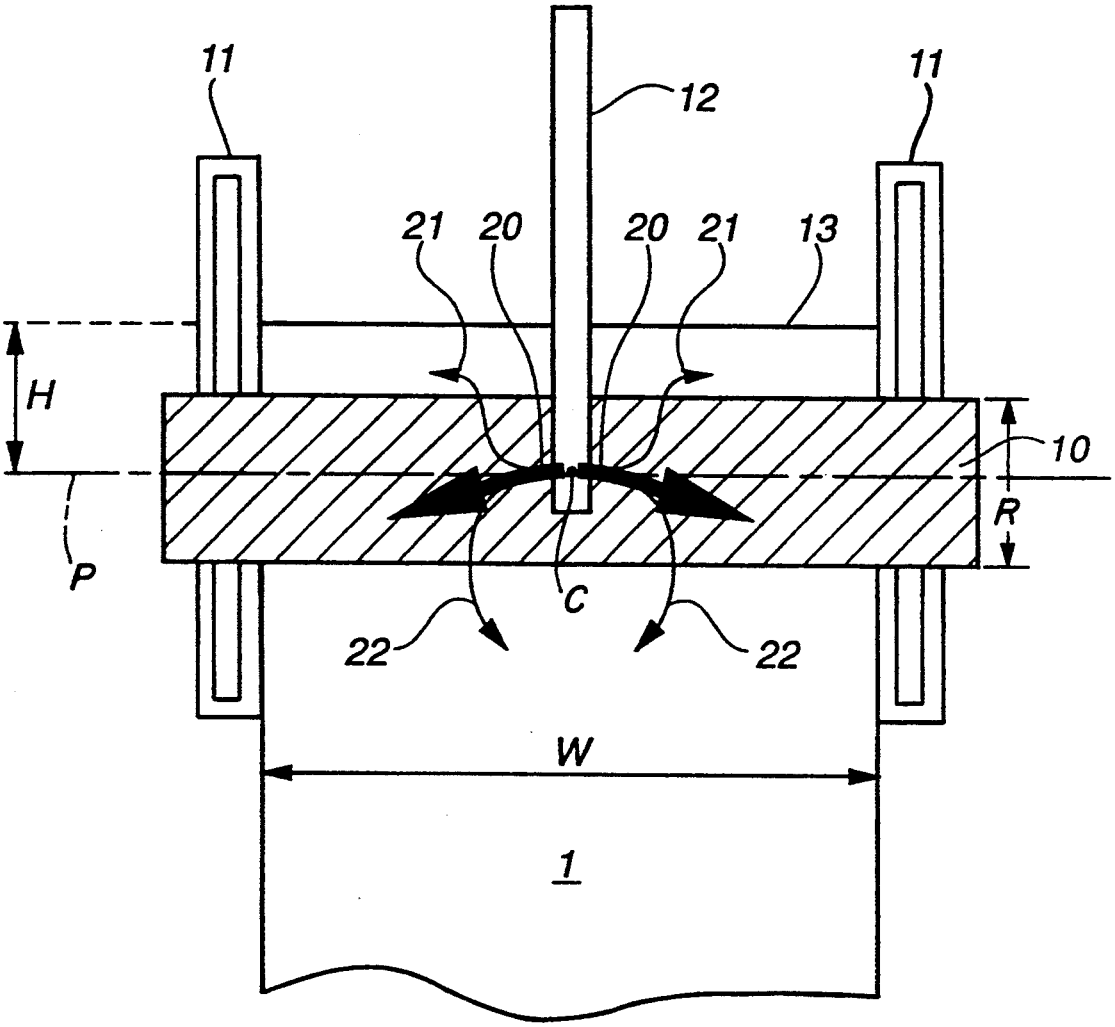
FIG. 1 is a schematic side view of a mould for casting a strand wherein the incoming molten metal is acted on by a static magnetic field according to the present invention.
Figure 2:
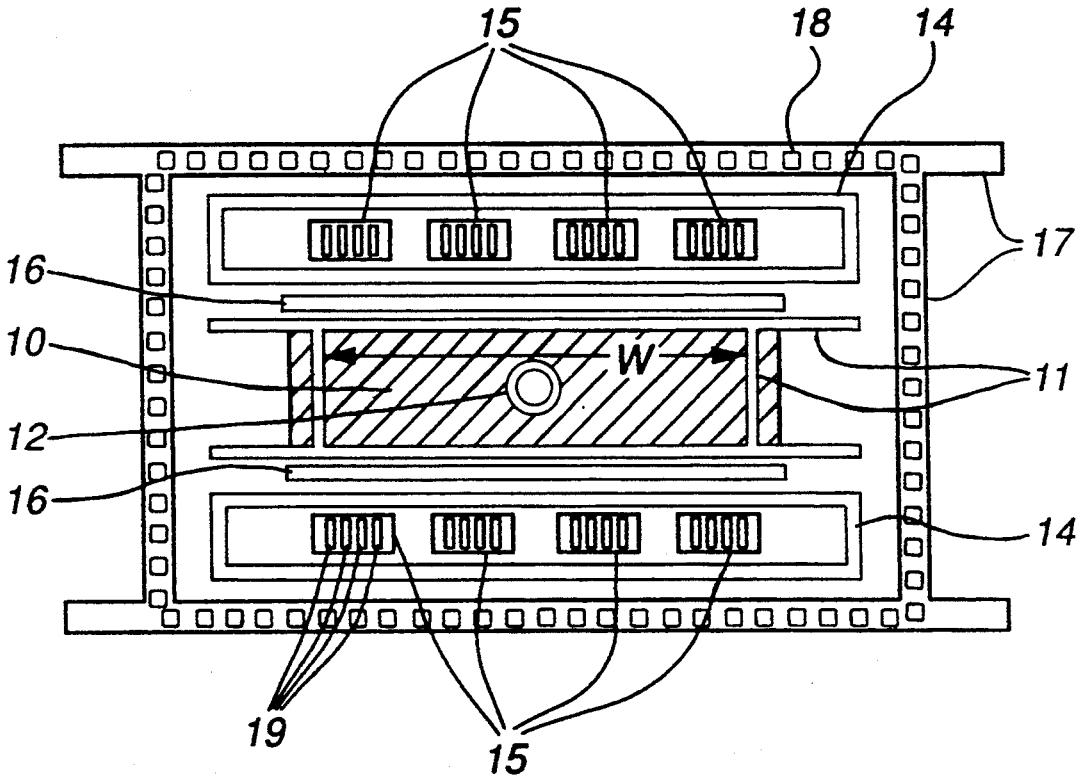
FIGS. 2 and 3 show schematic top and side views, respectively, of a mould for casting a strand with a preferred structure for generating the static magnetic field according to the present invention.
Figure 3:
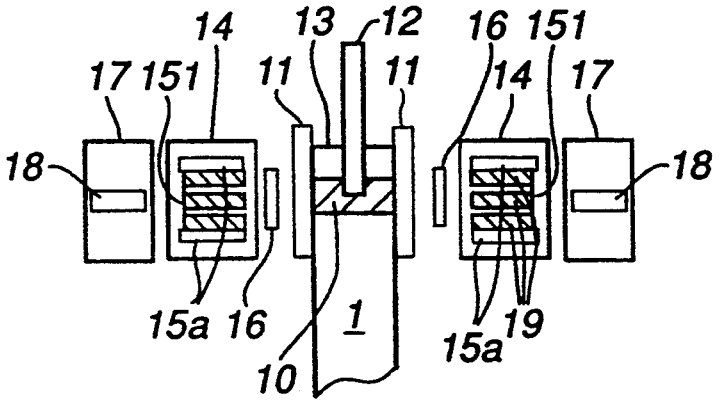
Figure 4:
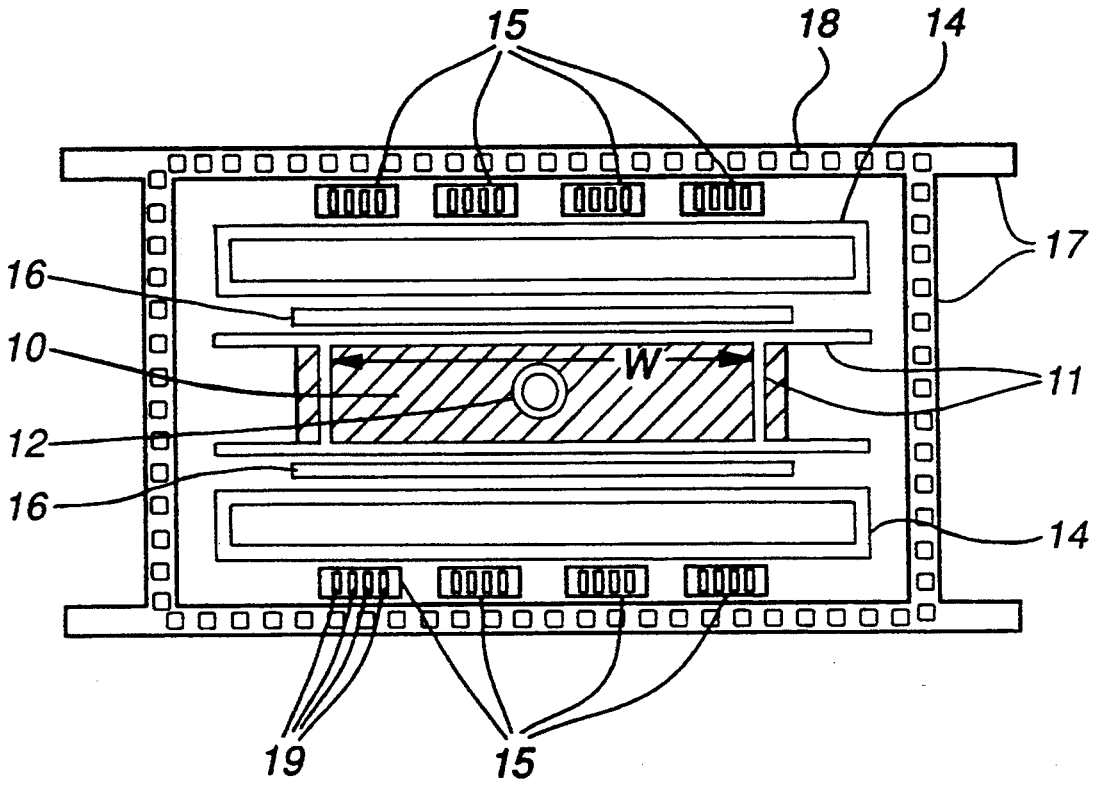
FIGS. 4 and 5 show schematic top and side views, respectively, of a mould for casting a strand with another preferred structure for generating the static magnetic field.
Figure 5:
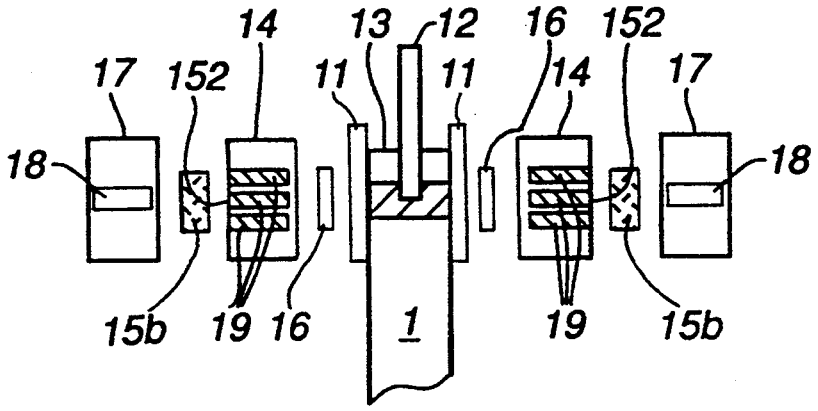

A static magnetic field for controlling the flow in non-solidified portions of a cast strand during casting in a mould is shown in FIG. 1, the magnetic field being adapted to act over essentially the whole width of a strand formed in the mould and the propagation and intensity being controlled and distributed according to the invention. FIGS. 2 to 5 show how magnetic poles, in the form of movable and/or adjustable magnetic poles, according to various embodiments of the invention are arranged in relation to the mould, water box beams arranged near the mould and a frame structure arranged around the water box beams.

In continuous casting of at least one cast strand in a mould, at least one static magnetic field 10 is applied, as is clear from FIG. 1, to brake and split up the molten metal flowing into the mould 11 through at least one primary flow 20 and to prevent the primary flow 20 of hot molten metal, which usually contains non-metallic particles, from penetrating deep down into the non-solidified parts of the cast strand 1. The molten metal can be supplied to the mould 11 through a free molten metal jet but is preferably adapted to be supplied through a casting tube 12. The casting tube 12 is provided with an arbitrary number of outlets, directed in an arbitrary manner, and is arranged preferably centrally in the mould 11. However, for different reasons, the primary flow 20 of inflowing hot molten metal will in many cases become unsymmetrical. According to the invention, therefore, one or a plurality of static magnetic fields 10 are adapted to act over essentially the whole width, W, of the strand 1 formed in the mould 11 and have a range of action R in the casting direction. This slows down the primary flow 20 and divides it into secondary flows 21, the flow of which is controlled, and a controlled circulation of molten metal in the non-solidified portions of the strand 1 is obtained, which entails a good separation of any accompanying particles, a good control of the casting structure as well as good conditions for increased productivity.

By arranging the static magnetic field 10, according to the invention, with the centers of its range of action R in the casting direction, its pole centre, at a distance, H, of 300 to 600 mm below the meniscus 13, a flow channel is obtained near the meniscus 13. This flow channel ensures a sufficient heat supply to the upper surface 13 of the molten metal to prevent this from solidifying without the turbulence and the wave formation near the upper surface 13 becoming too strong with an ensuing risk of slag being drawn down into the molten metal. In addition, it is ensured that non-metallic particles are separated and float up to the slag layer positioned on the upper surface 13.

According to the invention, the intensity and propagation of the magnetic field 10 are controlled and distributed such that the maximum field strength in the mould exceeds 1000 Gauss. Suitably, the maximum field strength in the mould should be kept within an interval of 1000 to 2000 Gauss, preferably within an interval of 1000 to 1800 Gauss. According to the invention, the field strength of the applied magnetic field 10, in a plane F perpendicular to the casting direction over the whole width of the cast strand 1 formed in the mould 11 and on a level with the centre C of the range of action R of the magnetic field, the pole centre, may vary within an interval of 60 to 100 per cent of the maximum field strength without the undesired, uncontrolled secondary flows arising.

As will be clear from FIGS. 2 to 5, continuous casting moulds usually comprise an inner chilled mould 11, preferably a water-cooled copper mould. The mould 11 is surrounded by water box beams 14, which in turn are surrounded by a frame structure 17. To bring about a control of the flow of the molten metal in the non-solidified portions of a strand 1 cast in the continuous casting mould, according to the invention, magnetic poles 15 are arranged in or near the water box beams 14 surrounding the mould 11 (see FIG. 3). Alternatively, the magnetic poles 15 are arranged between the water box beams 14 and the frame structure 17 surrounding the water box beams 14 (see FIG. 5). According to the invention, magnetic poles 15 are adapted to generate a static magnetic field 10 with a field strength whose intensity and propagation are controlled and distributed to act over essentially the whole width W of the strand 1 cast in the mould 11 and with a maximum magnetic field strength exceeding 1000 Gauss, while at the same time the magnetic field strength on a level with the meniscus has a maximum value of 500 Gauss. The frame structure 17 is provided with a magnetic return path 18, shown in the figures as an iron core provided in the frame structure 17, which together with the magnetic poles 15 and the magnetic field 10 acting between the poles 15 forms a magnetic circuit for the mould 11. The magnetic poles 15, the magnetic field 10 and the iron core 18 may, of course, be arranged such that circuits with magnetic flux balance are obtained for each mould half or for minor parts of the mould 11.

A construction as described above may entail considerable limitations of the possibility of inserting magnetic poles 15 in the form of both magnetic coils and permanent magnets, especially since a static magnetic field 10 covering essentially the whole width W of the cast strand 1 formed in the mould 11 is desired and where the intensity and propagation of the static magnetic field are controlled according to the invention. To overcome such limitations, the magnetic poles 15 are arranged, in one embodiment of the invention, movable in slots in the support beams 14 of the mould (see FIG. 3). Alternatively, the movable magnetic poles 15 may be arranged between the water box beams and the surrounding frame structure 17 (see FIG. 5). With magnetic poles 15 arranged movable, the intensity and propagation of the static magnetic field 10 can be easily changed in case of changes of the flow configuration, for example as a result of dimensional variations, preferably width variations, of the cast strand.

To further improve the possibilities of controlling and distributing the propagation and intensity of the magnetic field 10, according to one embodiment of the invention the magnetic poles 15 are provided with adjustable core elements 19, in the form of both magnetic and non-magnetic sections which can be respectively inserted/replaced to change the propagation and intensity of the magnetic field 10. With magnetic poles 15 in the form of induction coils **15*a* supplied with direct current (see FIG. 3), the core 151 of the coil is provided with adjustable core elements 19 of both magnetic and nonmagnetic material. In this way, the possibilities of controlling the intensity and propagation of the magnetic field 10 generated by means of the induction coil 15*a* are increased. With magnetic poles 15 in the form of permanent magnets 15*b* (see FIG. 5), a pole core 152 is arranged between the permanent magnet 15*b* and the mould 11, the pole core 152 consisting of magnetic and non-magnetic core elements 19 which are inserted/replaced to change the magnetic field 10 generated by the permanent magnet 15*b*. The permanent magnets 15*b*/induction coils 15*a*** can be respectively used in conjunction with various designs of casting moulds.

FIGS. 2 to 5 also show how, according to one embodiment of the invention, pole plates 16 are arranged adjacent to two sides of the mould 11 positioned opposite to each other. The pole plates 16 are adapted so as to extend along the sides of the mould 11. Behind the pole plates one of more magnetic poles 15 are arranged in the form of coils supplied with direct current, or permanent magnets. The fields from these magnetic poles 15 are brought together and distributed to generate and apply a static magnetic field 10 with a maximum field strength amounting to at least 1000 Gauss, suitably to between 1000 and 2000 Gauss, preferably to between 1000 and 1800 Gauss.

A static magnetic field 10, applied, controlled and distributed according to the invention, prevents molten metal from penetrating down into the cast strand 1 without being braked, while at the same time providing a control of the flow of the molten metal in non-solidified portions of the cast strand 1. In addition, it is ensured that non-metallic particles contained in the inflowing molten metal are separated towards the upper surface 13, that the upper surface/the meniscus 13 is supplied with a sufficient amount of hot molten metal not to solidify, and that the turbulence and wave formation at the meniscus are essentially avoided, which eliminates the risk of casting powder/slag being drawn down from the slag layer positioned on the upper surface 13. All in all, a better yield and a higher productivity are made possible, since improved quality control in the form of improved control of the amount of inclusions and the casting structure can be combined with increased availability and higher casting speed.

We claim:

1. A method of forming a cast strand in a mould, the cast strand having an upper non-solidified portion with a meniscus at an upper surface thereof and a lower solidified portion, said method comprising the steps of:

(a) supplying molten metal into said non-solidified portion of the cast strand so as to provide at least one primary flow of hot inflowing molten metal, and (b) applying a low-frequency static magnetic field in the mould so as to act over essentially a whole width of the cast strand and apply a maximum magnetic field strength over 1000 Gauss in a path of said inflowing metal to brake said at least one primary flow and form controlled secondary flows, the magnetic field strength in a plane transverse to a direction of casting and on a level with a center of a range of action of the magnetic field varying between 60 and 100% of said maximum value while the field strength in a plane level with the meniscus has a maximum value of 500 Gauss.

2. A method according to claim 1, wherein said maximum magnetic field strength is 1000 to 2000 Gauss.

3. A method according to claim 1, wherein in step (b) said low-frequency static magnetic field is applied such that the center of its range of motion is 300 to 600 mm below said meniscus.

4. A method according to claim 1, wherein in step (b) said low-frequency static magnetic field is generated by magnetic poles located adjacent to said mould.

5. A method according to claim 4, including a step (c) of changing said magnetic field by moving said magnetic poles.

* * * * *